US006511548B1

(12) United States Patent
Oreck et al.

(10) Patent No.: US 6,511,548 B1
(45) Date of Patent: Jan. 28, 2003

(54) METHOD AND APPARATUS FOR DELIVERING FRAGRANCE USING A FLOOR CARE DEVICE

(75) Inventors: David I. Oreck, New Orleans, LA (US); Bruce M. Kiern, Gulfport, MI (US)

(73) Assignee: Oreck Holdings, LLC, Cheyenne, WY (US)

( * ) Notice: Subject to any disclaimer, the term of this patent is extended or adjusted under 35 U.S.C. 154(b) by 48 days.

(21) Appl. No.: 09/675,486

(22) Filed: Sep. 29, 2000

(51) Int. Cl.[7] ..... A47L 9/00; A61L 9/02

(52) U.S. Cl. ..... 134/21; 15/339; 15/320; 15/344; 15/246.3; 422/5; 422/125

(58) Field of Search ..... 15/339, 320, 344, 15/246.3; 422/125, 5; 134/21

(56) References Cited

U.S. PATENT DOCUMENTS

| | | | | | |
|---|---|---|---|---|---|
| 1,931,165 | A | * | 10/1933 | Martinet | 15/246.3 |
| 2,130,484 | A | * | 9/1938 | Cummings | 15/246.3 |
| 2,694,771 | A | * | 11/1954 | Cox | 219/552 |
| 3,437,424 | A | * | 4/1969 | Erbor | 15/246.3 |
| 4,544,592 | A | | 10/1985 | Spector | |
| 4,554,698 | A | * | 11/1985 | Rennecker et al. | 15/246.3 |
| D287,656 | S | | 1/1987 | Waldrep et al. | D32/21 |
| 4,733,431 | A | | 3/1988 | Martin | 15/339 |
| 4,735,626 | A | | 4/1988 | Smith et al. | 8/137 |
| 5,029,359 | A | | 7/1991 | Ortega | 15/257 B |
| 5,040,264 | A | | 8/1991 | Bryant | 15/339 |
| 5,074,997 | A | * | 12/1991 | Riley et al. | 106/15.05 |
| 5,276,939 | A | | 1/1994 | Uenishi | 15/319 |
| 5,336,128 | A | | 8/1994 | Birdsong | 454/56 |
| 5,342,420 | A | | 8/1994 | Bosses | 55/279 |
| 5,511,278 | A | * | 4/1996 | Shorthill | 15/246.2 |
| 5,891,400 | A | * | 4/1999 | Ansari et al. | 422/122 |
| 5,964,404 | A | | 10/1999 | Randolph | 239/56 |
| 6,115,854 | A | * | 9/2000 | Haghayegh | 4/420.2 |

OTHER PUBLICATIONS

The Complete Oreck Products Catalog, Oct. 1, 1999.

* cited by examiner

*Primary Examiner*—Theresa T. Snider
(74) *Attorney, Agent, or Firm*—Faegre & Benson LLP

(57) ABSTRACT

Fragrance delivery apparatus and methods for use in combination with a floor care device are shown and described. In one embodiment, the fragrance delivery apparatus incorporates a mass that can be impregnated with a heat sensitive, fragrant substance. The fragrant substance is substantially stable at ambient temperature, but is freely released from the mass at an elevated temperature. The mass is coupled to a housing on a floor care device at a location that becomes warm during operation. As a result, when the floor care device is operated, the fragrance delivery apparatus becomes warm, and the fragrant substance is released into the nearby environment. When the floor care device is stored, however, the fragrant substance is not released from the mass in significant amounts.

42 Claims, 9 Drawing Sheets

METHOD AND APPARATUS FOR DELIVERING FRAGRANCE USING A FLOOR CARE DEVICE

TECHNICAL FIELD

The invention relates to fragrance delivery methods and apparatus. More particularly, the invention relates to methods and apparatus for use in combination with a floor care device to deliver a fragrant substance to a surrounding environment.

BACKGROUND OF THE INVENTION

Many products have been developed for deodorizing rooms and carpets, or for making the rooms and carpets more fragrant. For example, powders and sprays have been developed to apply directly to the carpet. As the carpet is vacuumed, the powder or residue from the spray is drawn into the vacuum bag and the fragrance is distributed through the room.

Tablets and granules impregnated with fragrances have also been developed for insertion into the vacuum cleaner bag. Each time the vacuum cleaner is run, fragrance from the tablets or granules is distributed throughout the room.

A number of problems can result from one or more of these products. First, in general, these products continuously emit odor into the surrounding environment. As a result, the area where the vacuum cleaner is stored may become excessively fragrant, as can neighboring areas. Second, because these systems continuously generate fragrance, their useful life span may be reduced. As a result, these products may require replacement more frequently than necessary. Third, powders, tablets and granules may prematurely fill the vacuum bag, resulting in a reduced efficiency of the vacuum cleaner motor and bag as well as reduced life span of the bag. Users may therefore need to replace the vacuum bag and, possibly, the vacuum motor, more frequently than necessary.

SUMMARY OF THE INVENTION

The present invention is directed toward fragrance delivery apparatus for use in combination with floor care devices, and for methods of using floor care devices to delivery fragrant substances. In one embodiment, the fragrance delivery apparatus includes a mass that can be impregnated with a fragrant substance, such as an oil or other compound. The mass is coupled to a sensitive area on the floor care device at which the temperature increases during operation. When the mass is impregnated with the fragrant substance and the floor care device is operated, the temperature of the mass increases along with that of the sensitive area, and the fragrant substance is released into the surrounding environment. After the floor care device ceases operation, the temperature of the mass decreases to the ambient temperature, at which the fragrant substance is substantially stable and is released into the environment at a reduced rate, if at all.

In another embodiment, the invention also contains a retention element, such as a strap, clip, bracket or adhesive, for temporarily retaining the mass to the sensitive area of the floor care device. When the mass requires refilling or replacement, it may be removed from the retention element and replaced, or it can be refilled, such as with a liquid form of fragrant substance.

In yet another embodiment, the apparatus is positioned within a path of air circulating to cool the motor of the floor care device. When the motor of the floor care device heats up, the apparatus also heats up to release the fragrant substance into the surrounding environment. Because the apparatus is positioned in the path of the motor cooling air, the fragrant substance is carried with the motor cooling air and emitted into the surrounding environment at an increased rate.

DETAILED DESCRIPTION OF THE ILLUSTRATED EMBODIMENTS

The present invention is generally directed toward apparatus used in combination with floor care devices to distribute fragrant substances in selected areas, and toward methods of delivering fragrant substances using floor care devices. Several particular embodiments of the invention may allow the fragrant substances to be distributed to the selected areas when the floor care device is operating, but not when the floor care device is being stored. As a result, the fragrant substance may have a longer useful life, and the area in which the floor care device is stored may not become overpowered by the fragrant substance. Many specific details of certain embodiments of the invention are set forth in the following description and in FIGS. 1–18 to provide a thorough understanding of such embodiments. One skilled in the art, however, will appreciate that the present invention may have additional embodiments, or that the invention may be practiced without several of the details described in the following description.

Figure 1:
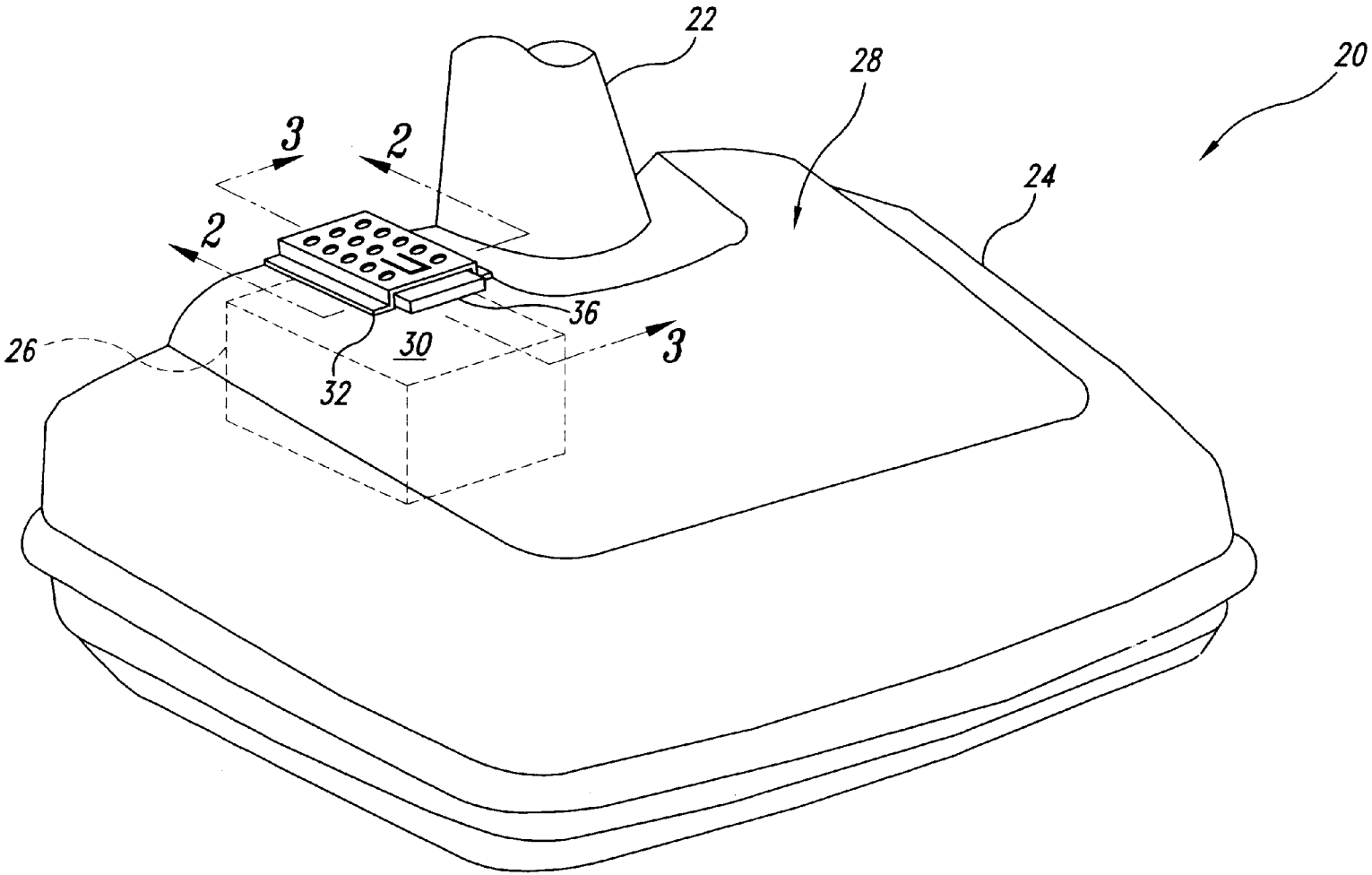
FIG. 1 is an isometric view of a portion of a floor care device and a fragrance delivery apparatus according to an embodiment of the present invention.

FIG. 1 illustrates a portion of a vacuum cleaner 20 incorporating a handle assembly 22 and a base 24. The base 24 is designed to move over a floor or similar surface, and a motor 26 within the base 24 operates a fan (not shown) that draws dirt-entrained air from the floor and into the vacuum cleaner 20. The base 24 has a housing 28 that encases the motor 26 and other functional parts of the vacuum cleaner 20. During operation of the vacuum cleaner 20, when the motor 26 warms up, a number of sensitive areas 30 on the housing 28 also may get warm. Also incorporated within the housing is a cooling system (not shown) for cooling the motor during use. As generally understood in the industry, the cooling system incorporates an intake port through which cooling air enters the housing, conduits through which the cooling air travel, and a fan that propels the cooling air into the housing, past the motor, and out from the housing. As a result, air passes by the motor and keeps the motor from becoming excessively hot.

Figure 2:
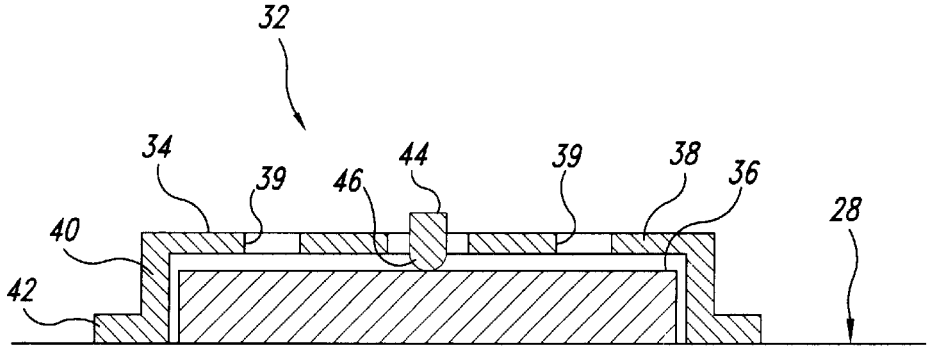
FIG. 2 is a sectional end elevation view of the fragrance delivery apparatus of FIG. 1, viewed along Section 2—2.
Figure 3:
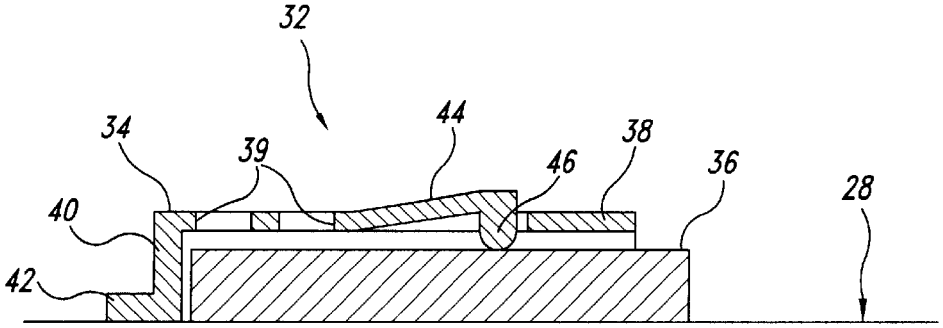
FIG. 3 is a sectional side elevation view of the fragrance delivery apparatus of FIG. 1, viewed along Section 3—3.

In the illustrated embodiment, a fragrance delivery apparatus 32 is affixed to the housing 28 near one of the sensitive areas 30. As best illustrated in FIGS. 2 and 3, the fragrance delivery apparatus 32 incorporates a bracket 34 and an impregnated medium 36. The illustrated bracket 34 has a generally rectangular upper plate 38, shaped to conform with the shape of the impregnated medium 36. The upper plate 38 is closed on three sides by a wall 40 and a flange 42. The flange 42 is attached to the housing 28, and is located near one of the sensitive areas 30 (FIG. 1). The flange 42 can be permanently attached to the housing 28, such as by an adhesive, rivet or similar fastener, or can be removably attached to the housing, such as by Velcro or other suitable means. As illustrated in FIG. 1, a fourth edge of the fragrance delivery apparatus 32 remains open to allow the impregnated medium 36 to be inserted into or removed from the fragrance delivery apparatus.

The wall 40 and the upper plate 38 are sized to be slightly larger than the respective dimensions of the impregnated medium 36 so that the impregnated medium can be manually inserted into and removed from the fragrance delivery apparatus 32. Although the upper plate 38 and impregnated medium 36 are illustrated as being rectangular, it is appreciated that these elements can instead be oval, square, or of any other suitable size or shape. The upper plate 38 is fabricated with an array of apertures 39 distributed throughout the upper plate to allow an airborne fragrant substance to escape the fragrance delivery apparatus 32. It is understood that the size, shape and spacing of the apertures 39 can vary dramatically, yet still serve the purpose of the present invention.

Centrally located on the upper plate 38 is a finger 44 that terminates at its distal end in a protuberance 46 directed toward the impregnated medium 36. In its relaxed state, when the impregnated medium 36 has been removed from the fragrance delivery apparatus 32, the finger 44 generally lies within the plane of the upper plate 38. When the impregnated medium 36 is inserted into the fragrance delivery apparatus 32, the impregnated medium contacts the protuberance 46. As the impregnated medium 36 is urged past the protuberance 46, the impregnated medium urges the protuberance and the finger 44 away from the impregnated medium. As a result, the finger 44 and protuberance 46 operate to retain the impregnated medium 36 in the fragrance delivery apparatus 32, and retain the impregnated medium in contact with the housing 28. In the illustrated embodiment, the impregnated medium 36 and the housing 28 abut along planar surfaces. It is appreciated, however, that these elements can have a wide variety of shapes, and, similarly, the impregnated medium can be flexible to conform to any shape that the housing takes.

The impregnated medium 36 of this embodiment is fabricated from a porous, rigid material, such as a felt, foam, ceramic or polymeric material. The porous material can be impregnated with a fragrant substance, such as an essential oil or an organic or synthetic compound. The particular compound used in this embodiment is heat sensitive; it is stable at common ambient temperatures, but released in vapor form at elevated temperatures. The particular fragrances used include those sold in association with the Oreck trademarks SPRING MULBERRIES, NOTES OF VANILLA, and BLOOMING JASMINE. Such fragrances often comprise chemicals including esters, ketones, organic alcohols, hydrocarbons, or acetone. As a result, when the vacuum cleaner 20 is not being operated and is at an ambient temperature, the fragrant substance remains within the porous material of the impregnated medium 36. When the vacuum cleaner 20 is being operated, however, and the temperature of the housing 28 increases, the impregnated medium 36 also increases in temperature and, as a result, the heat sensitive fragrant substance is released from the impregnated medium into the surrounding area. Thus, the fragrance delivery apparatus 32 delivers fragrant substances to a room when the vacuum cleaner is being operated, but not when the vacuum cleaner is being stored.

Although the illustrated embodiment uses an impregnated medium 36 made from a rigid material, it is appreciated that this medium could similarly be made from a foam material, sponge material, paper or other compressed wood-based materials, other synthetic materials with similar properties, or any other suitable material generally understood in the art.

Figure 4:
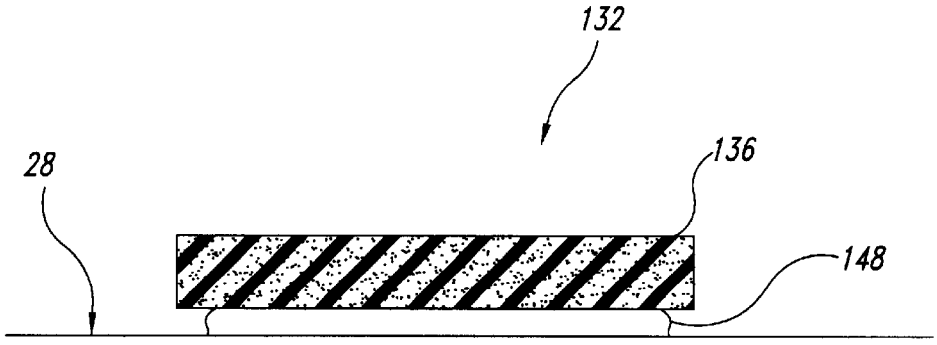
FIG. 4 is a sectional elevation view of another fragrance delivery apparatus according to another embodiment of the present invention.

FIG. 4 illustrates a fragrance delivery apparatus 132 according to another embodiment of the present invention. In this particular embodiment, an impregnated medium 136 is attached by an adhesive 148 to the vacuum cleaner housing 28. The adhesive 148 allows heat from the motor (not shown) to transfer from the housing 28 to the impregnated medium 136. It is understood that any known adhesive with such qualities would be suitable.

Although the fragrance delivery apparatus 132 of FIG. 4 is shown attached to the vacuum cleaner's housing 28, it is appreciated that the apparatus could similarly be attached directly to the motor, or to other parts of the vacuum cleaner that become warm during operation. The impregnated medium 136 of this embodiment is made from a foam material, although the material may vary as discussed herein or as otherwise understood in the art.

Figure 5:
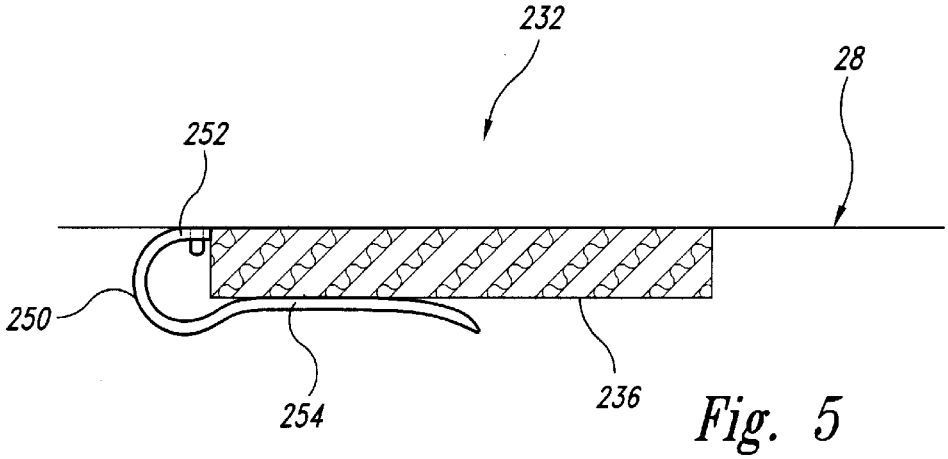
FIG. 5 is a sectional elevation view of yet another fragrance delivery apparatus according to yet another embodiment of the present invention.

FIG. 5 illustrates another fragrance delivery apparatus 232 according to yet another embodiment of the present invention. In this particular embodiment, a resilient clip 250 having a short leg 252 and a long leg 254 retains an impregnated medium 236 against the housing 28 of the vacuum cleaner 20. The short leg 252 of the clip 250 is attached to the housing 28, and the long leg 254 is spaced apart from the housing and extends along a section of housing. In its unstressed state, the long leg 254 of the clip 250 is spaced apart from the housing 28 by a distance slightly smaller than the thickness of the impregnated medium 236. Consequently, when the impregnated medium 236 is inserted between the long leg 254 and the housing 28, the long leg 254 retains the impregnated medium 236 to the housing, and urges the impregnated medium against the housing. Although FIG. 5 illustrates the short leg 252 being fixed, such as with a rivet, to the housing 28, it is appreciated that the short leg can be fixed or removably coupled to the housing by a wide variety of suitable means. The impregnated medium 236 of this embodiment is made from a paper-based material, although the material may vary as discussed herein or as otherwise understood in the art.

Figure 6:
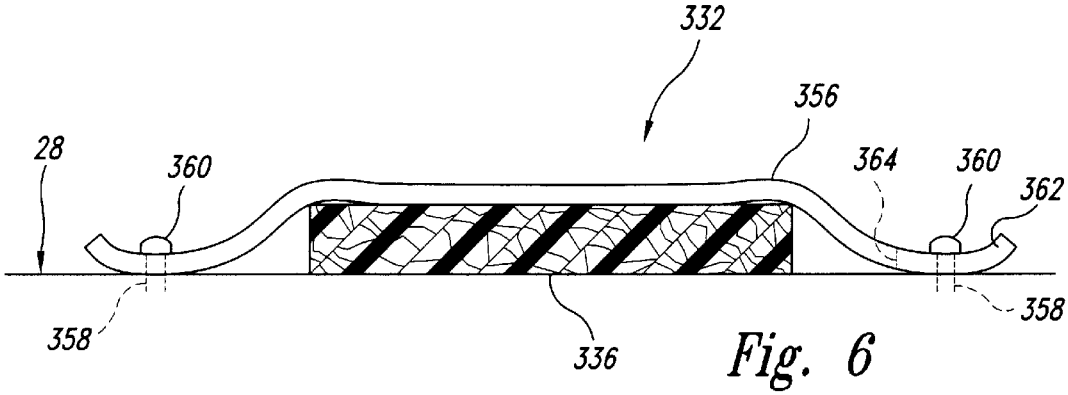
FIG. 6 is a sectional elevation view of still another fragrance delivery apparatus according to still another embodiment of the present invention.

FIG. 6 illustrates another embodiment of a fragrance delivery apparatus 332 according to another embodiment of the present invention. In this particular embodiment, a strap 356 retains an impregnated medium 336 against the housing 28 of the vacuum cleaner 20, and urges the impregnated medium against the housing.

In the illustrated embodiment, a pair of projections 358, each having an enlarged head 360, are fixed to the housing 28. The strap 356 is retained to the housing 28 by the projections 358. A working end 362 of the strap 356 has an enlarged opening 364, allowing the working end of the strap to be engaged with and disengaged from the projection 358 as desired by the user.

In the illustrated embodiment, the strap 356 is fabricated from an inelastic material, such as nylon, leather or some other suitable material and the impregnated medium 336 is made from a synthetic sponge. It is appreciated, however, that the strap 356 can be fabricated from an elastic material, and the material of the impregnated medium 336 can vary as discussed herein or as otherwise understood in the art.

Figure 7:
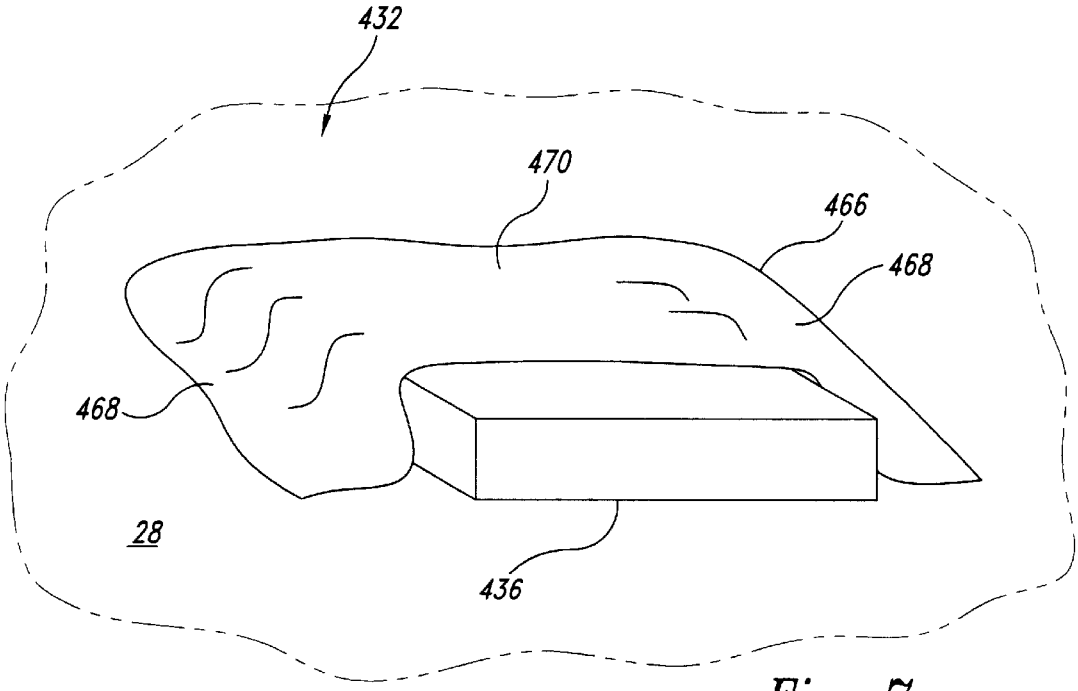
FIG. 7 is an isometric view of a portion of a floor care device and a fragrance delivery system of still another embodiment of the present invention.

FIG. 7 illustrates a fragrance delivery apparatus 432 according to yet another embodiment of the present invention. In this particular embodiment, a fabric pocket 466 is attached along two opposing edges 468 and a third edge 470 to the housing 28. The fabric pocket 466 is fabricated from a permeable material, thereby allowing the fragrance released from the impregnated medium 436 to disperse into the surrounding environment. The fabric pocket 466, for example, can be a net mesh or elastic weave, thereby retaining the impregnated medium 436 and urging it against the housing 28. Although the fabric pocket 466 is illustrated with the third edge 470 attached to the housing 28, it is appreciated that the fabric pocket could function with only the opposing edges 468 attached to the housing.

Figure 8:
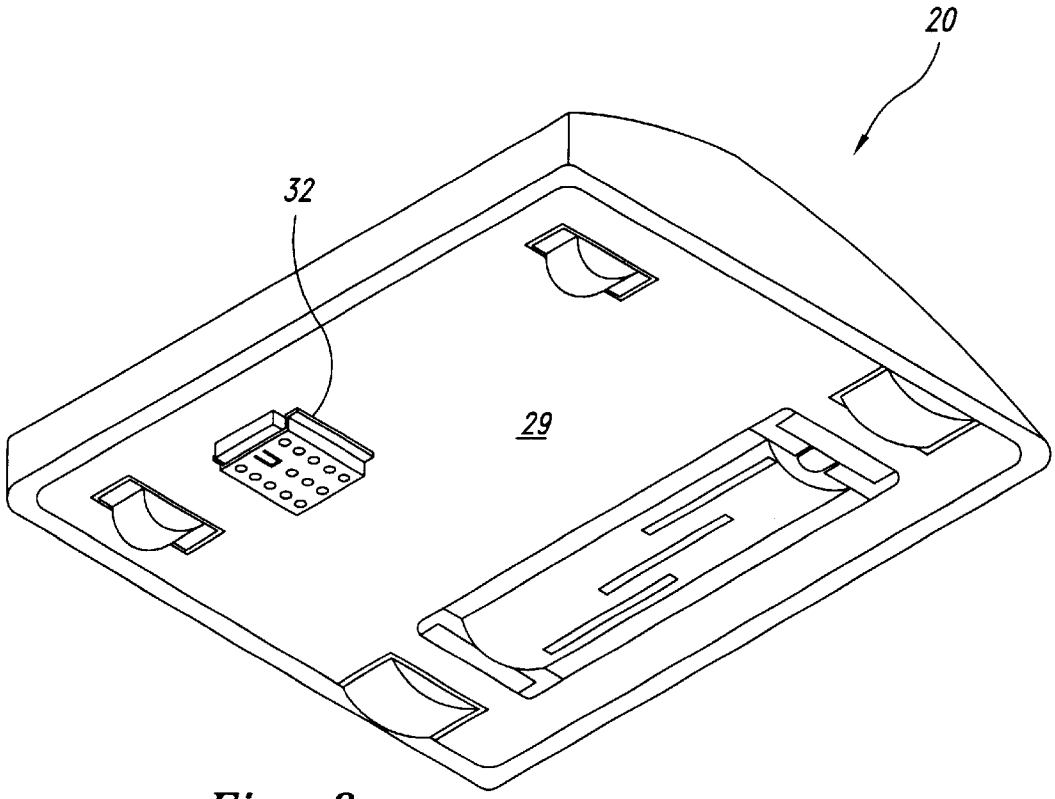
FIG. 8 is a bottom isometric view of a vacuum cleaner and fragrance delivery system according to an embodiment of the present invention.
Figure 9:
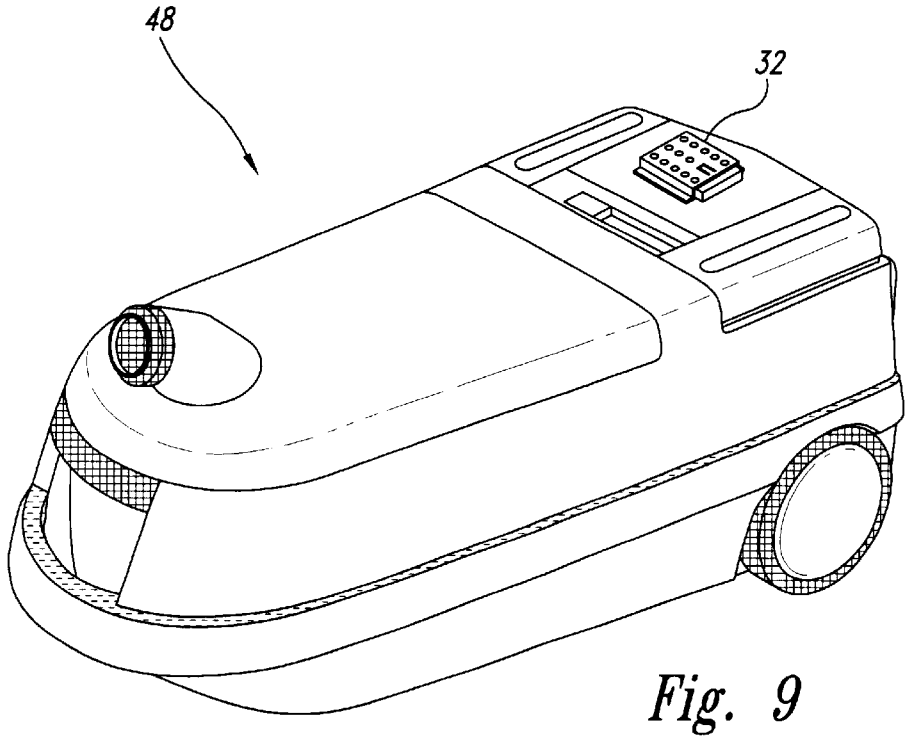
FIG. 9 is an isometric view of a canister vacuum and fragrance delivery system according to an embodiment of the present invention.
Figure 10:
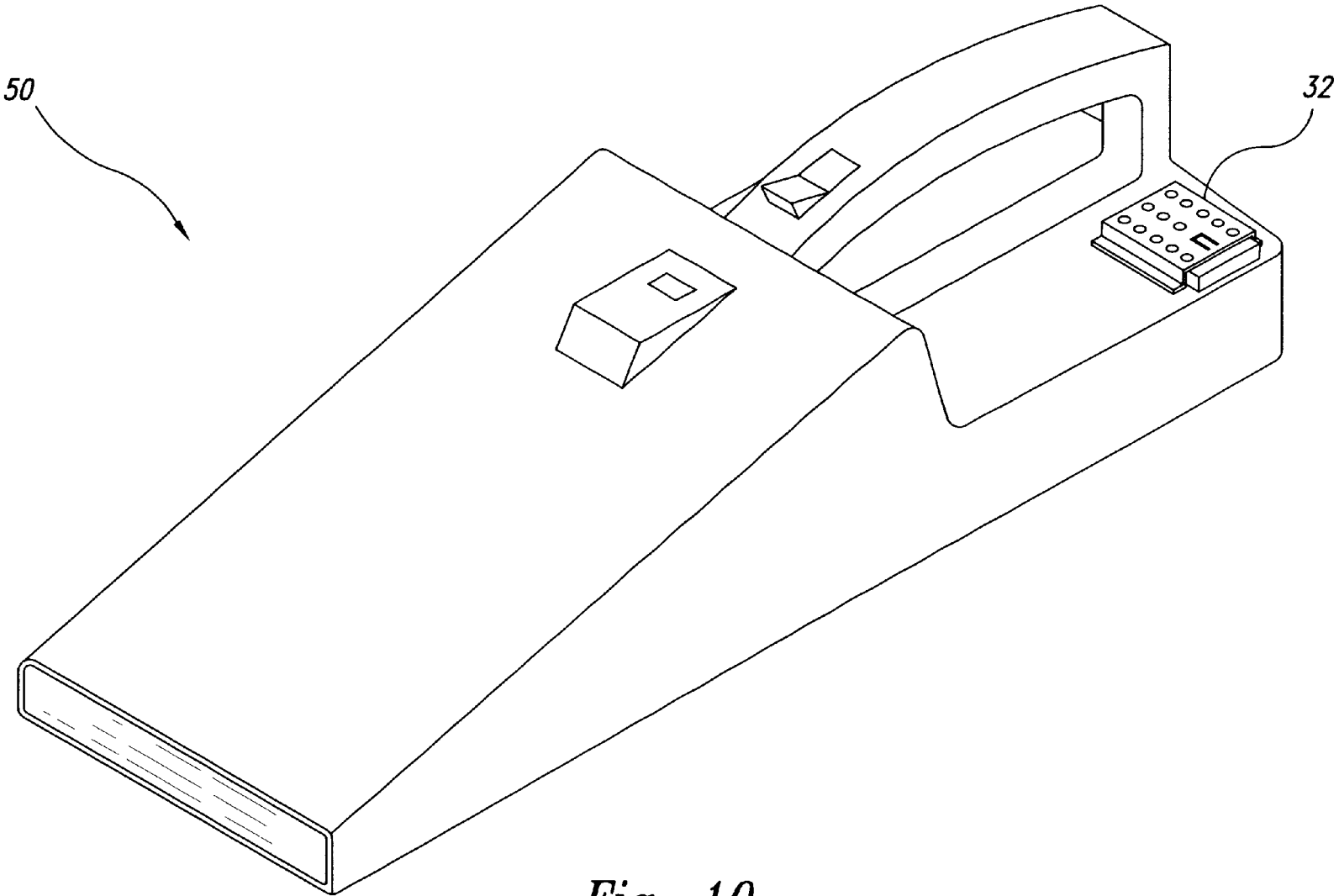
FIG. 10 is an isometric view of a hand-held vacuum cleaner and fragrance delivery system according to an embodiment of the present invention.
Figure 11:
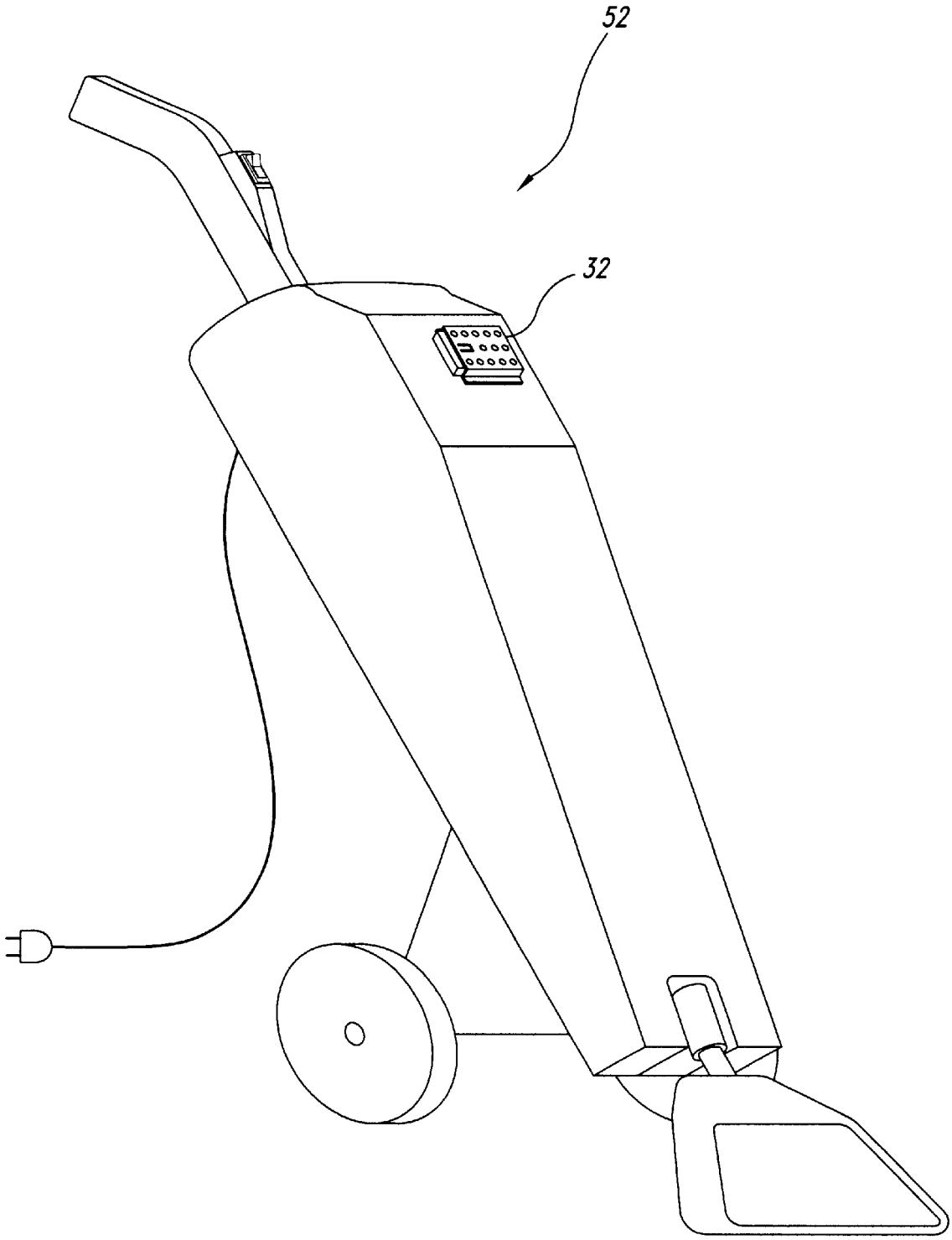
FIG. 11 is an isometric view of an extractor and fragrance delivery system according to an embodiment of the present invention.
Figure 12:
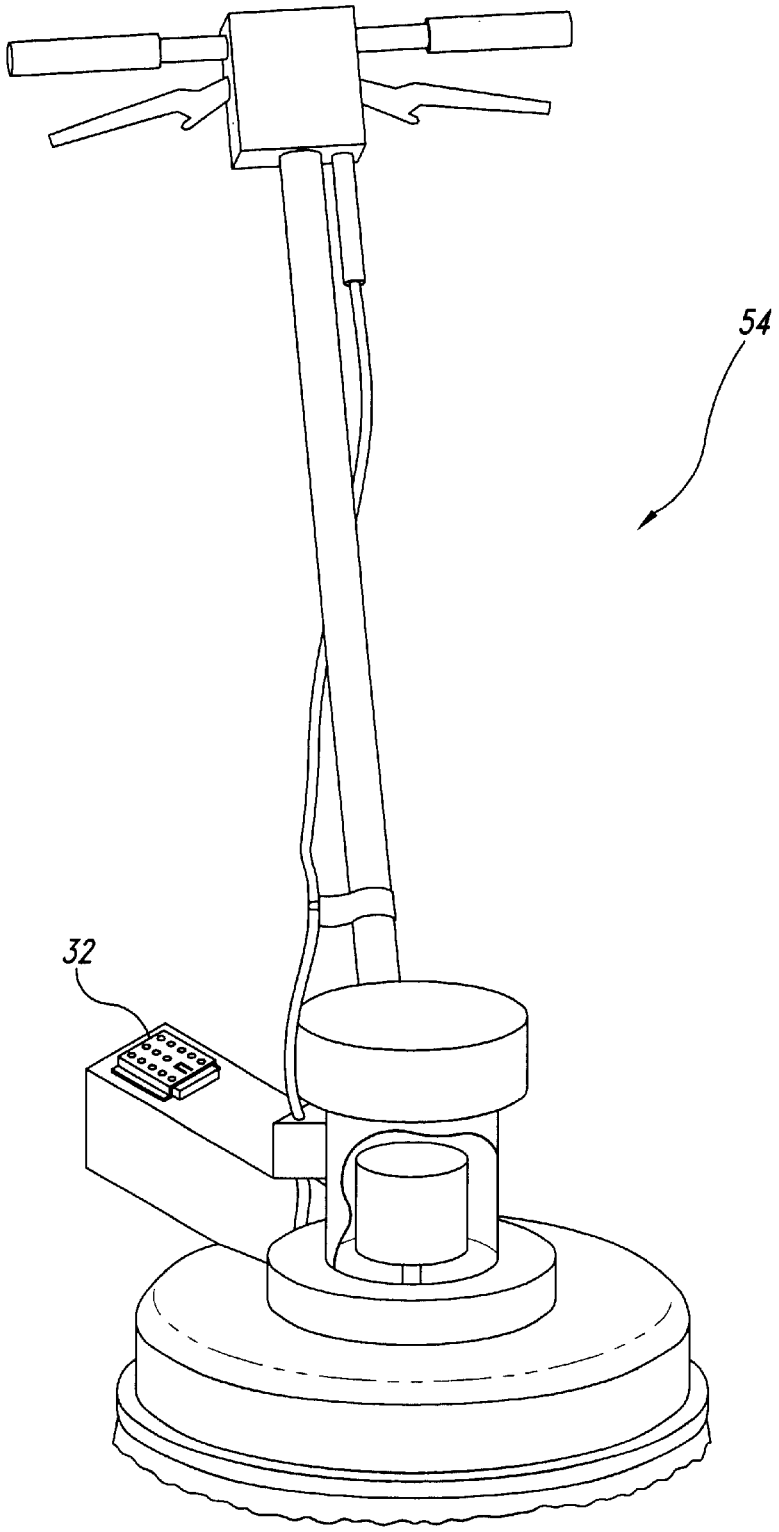
FIG. 12 is an isometric view of a floor machine and fragrance delivery system according to an embodiment of the present invention.

FIGS. 8–12 illustrate some of the possible variations in which the fragrance delivery apparatus 32 can be used. For example, FIG. 8 illustrates that the fragrance delivery apparatus 32 can be coupled to an underside 29 of a vacuum cleaner 20. FIGS. 9–12 illustrate that the fragrance delivery apparatus 32 can be attached to a canister vacuum 48, a hand-held vacuum 50, an extractor 52, and a floor machine 54, respectively.

Figure 13:
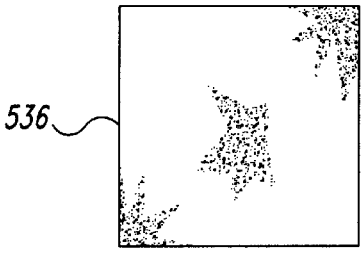
FIG. 13 is a plan view of an impregnated felt medium of yet another fragrance delivery apparatus according to an alternate embodiment of the present invention.
Figure 14:
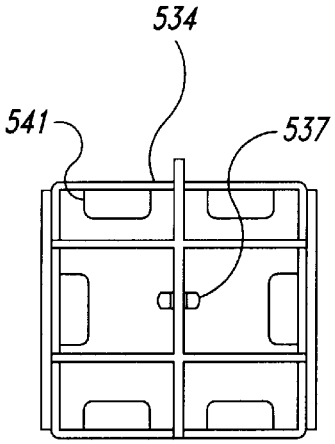
FIG. 14 is a plan view of a housing from the fragrance delivery apparatus of the alternate embodiment of the present invention.
Figure 15:
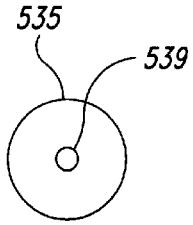
FIG. 15 is a plan view of a retaining member of the fragrance delivery apparatus according to the alternate embodiment of the present invention.

FIGS. 13 through 18 illustrate an alternate embodiment of the fragrance delivery system of the present invention. As best illustrated in FIGS. 13 through 15, respectively, this alternate embodiment of the invention incorporates a felt medium 536, a removable bracket 534, and a retaining ring 535. The felt medium 536 and the bracket 534 meet the same general description as those given above in connection with the prior embodiments. In this particular embodiment, however, the bracket 534 incorporates a retention stem 537 that projects laterally across the center of the bracket 534. The retaining ring 535, illustrated in FIG. 15, has a hole 539 sized to captively receive the retention stem 537 on the bracket 534.

Figure 16:
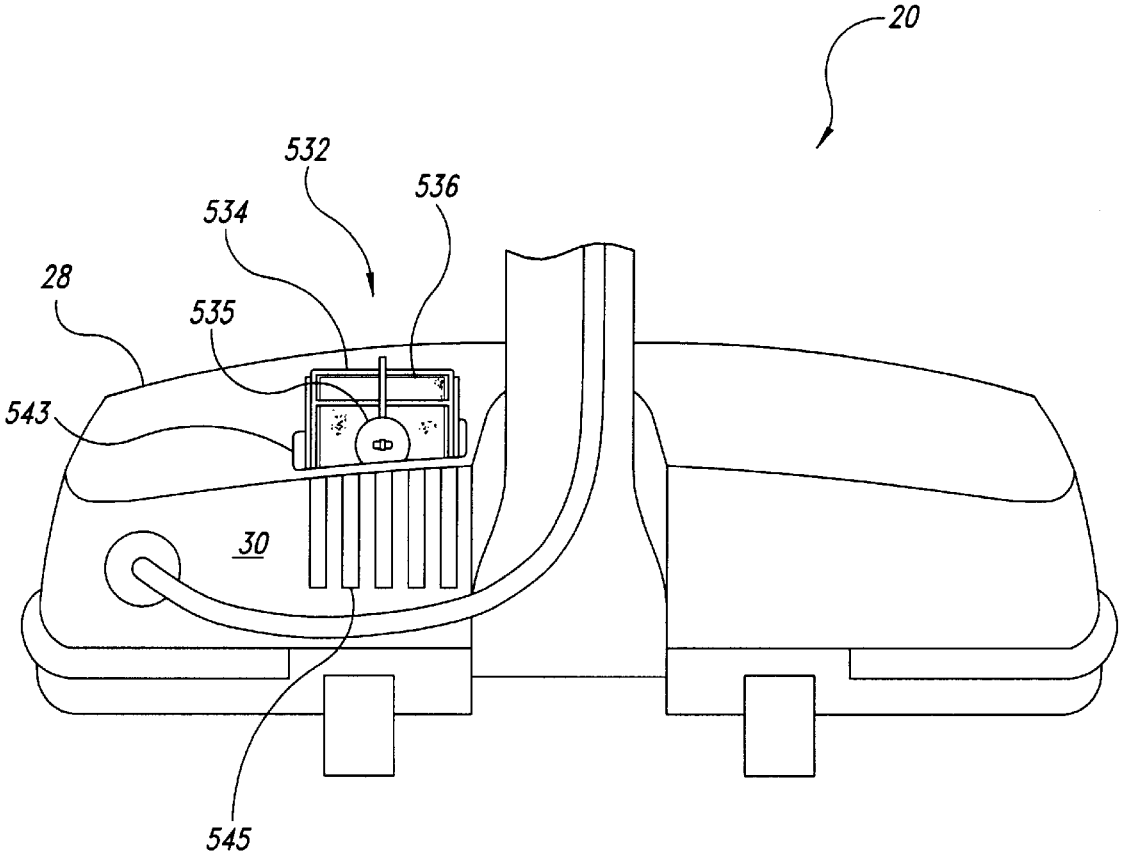
FIG. 16 is a rear elevation view of a portion of a floor care apparatus and the fragrance delivery apparatus of the alternate embodiment of the present invention in a first position.

FIG. 16 illustrates the fragrance delivery system 532 of this alternate embodiment during assembly. As illustrated, the felt medium 536 is placed within the boundaries of the bracket 534, and compressed against the retention stem 537 until the stem passes through the soft felt material of the felt medium. The retaining ring 535 then captively engages the retention stem 537 to retain the felt medium 536 within the bracket 534. In the embodiment illustrated in FIG. 14, a plurality of tabs 541 are positioned around the perimeter of the bracket 534 to retain the edges of the felt medium 536 within the bracket.

The assembled fragrance delivery apparatus 532 in FIG. 16 is being inserted into a cavity 543 in the housing 28 of the vacuum cleaner 20. The cavity 543 is located on the housing 28 adjacent a number of vents 545 for the vacuum cleaner's motor cooling intake. Accordingly, when the motor cooling system (described above) operates, the motor cooling air enters the vents 545, passes through the impregnated felt medium 546, and is then emitted into the surrounding atmosphere. The motor cooling system is typically located near the motor, which results in the vents 545 being located at or near a sensitive area 30 on the housing 28 of the vacuum cleaner 20.

Figure 17:
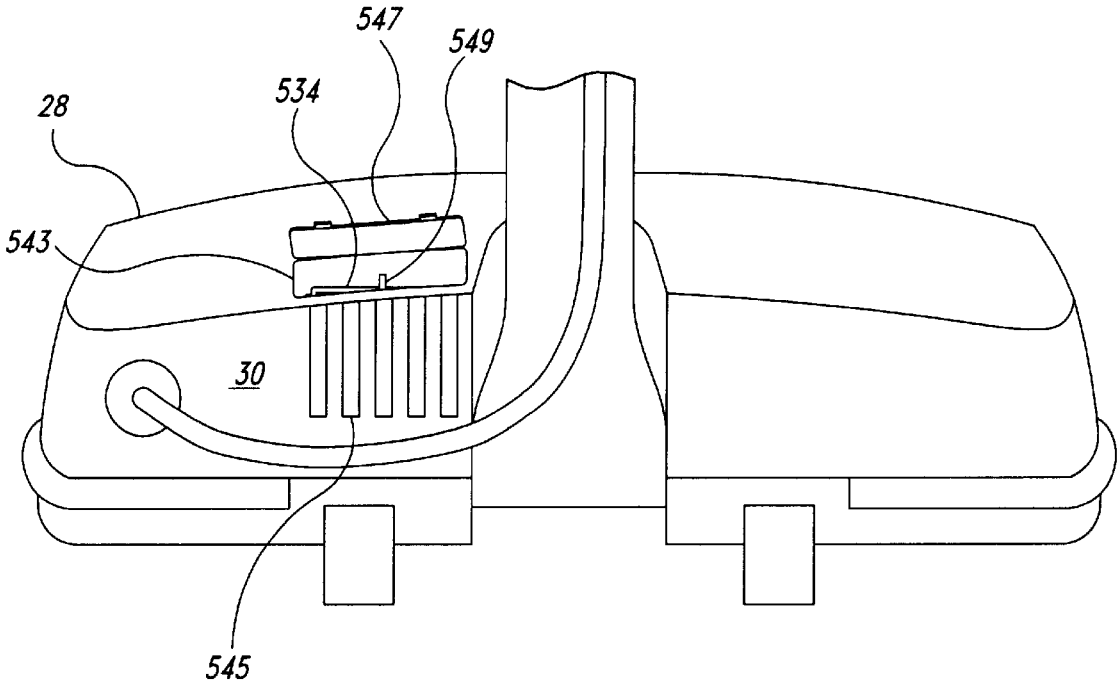
FIG. 17 is a rear elevation view of the floor care apparatus and the fragrance delivery system of FIG. 16 in a second position.

As illustrated in FIG. 16, the bracket 534 is narrower than the cavity 543, allowing the bracket to fit within the cavity. As illustrated in FIG. 17, the cavity 543 is also deeper than the height of the bracket 534. Consequently, when the bracket 534 is fully inserted in the cavity 543, the bracket falls completely within the external boundary of the housing. It is fully appreciated, however, that the bracket 534 can be only partially inserted into the cavity 543, or that the relative sizes or shapes of the bracket and the cavity can be changed to suit any particular need or function of a specific situation.

Figure 18:
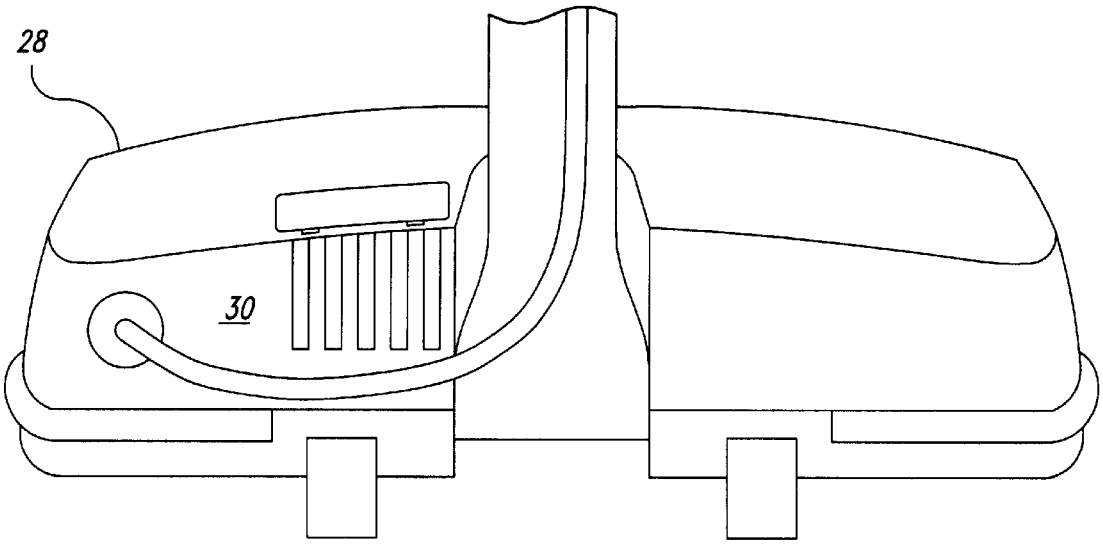
FIG. 18 is a rear elevation view of the portion of the floor care apparatus containing the fragrance delivery system of FIG. 16 in a third position.

In the illustrated embodiment, a lid 547 is rotatably coupled to the housing 28 to move between an open position in which the bracket 534 can be inserted into or removed from the cavity, and a closed position (as illustrated in FIG. 18) in which the lid retains the bracket within the housing.

The illustrated bracket 534 also has a handle 549 to assist the user in inserting and removing the bracket from the cavity 543. Although the lid 547 in the illustrated embodiment is hingedly attached to the housing 28, it is appreciated that the engagement between the lid and the housing have a wide variety of configurations yet still perform the necessary function. It is also envisioned that the system not incorporate a lid at all.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A fragrance delivery system having a vacuum cleaner, the vacuum cleaner having a body and a motor within the body, the body having at least one sensitive area at which heat is generated by the motor during operation of the vacuum cleaner raises the temperature of the at least one sensitive area above an ambient temperature, the system further comprising:

a retention element configured to be attached to the body of the vacuum cleaner; and a fragrant mass impregnated with a heat sensitive, fragrant substance, the fragrant mass being engaged with the retention element such that, during operation, when the retention element is attached to the body of the vacuum cleaner with the fragrant mass in contact with the at least one sensitive area, the temperature of the fragrant mass increases and at least some of the fragrant substance is released from the fragrant mass.

2. The system of claim 1 wherein the retention element comprises an adhesive.

3. The system of claim 1 wherein the retention element comprises an elongated strap.

4. The system of claim 1 wherein the retention element comprises an elongated elastic strap.

5. The system of claim 1 wherein the retention element comprises a bracket.

6. The system of claim 1 wherein the retention element comprises a bracket having an internal cavity for retaining the fragrant mass therein, and having a plurality of openings to allow the fragrant substance to escape from the internal cavity.

7. The system of claim 1 wherein the retention element comprises a bracket having a closure movably coupled to the retention element to move between a first position in which the fragrant mass can be inserted into and removed from the retention element, and a second position in which the fragrant mass is captured by the retention element.

8. The system of claim 1 wherein the retention element comprises a section of pliable material.

9. The system of claim 1 wherein the retention element comprises a section of pliable material having a plurality of lateral edges, at least two of the lateral edges being attachable to the body of the vacuum cleaner.

10. The system of claim 1 wherein the retention element comprises a resilient member configured to retain the fragrant mass to the body of the vacuum cleaner, and to urge the fragrant member against the at least one sensitive area of the body.

11. The system of claim 1 wherein the retention element comprises a resilient member having first and second end portions, the first end portion of the resilient member being attachable to the body of the vacuum cleaner, the second end portion of the resilient member being deformable to receive the fragrant mass, deformation of the resilient member generating a restoring force for retaining the fragrant mass to the at least one sensitive area of the body.

12. The system of claim 1 wherein the retention element comprises a biasing element configured to urge the fragrant mass against the at least one sensitive area of the body when the fragrant mass is engaged with the retention element.

13. The system of claim 1 wherein the retention element is configured to be fixedly attached to the body of the vacuum cleaner.

14. The system of claim 1 wherein the retention element is configured to be removably attached to the body of the vacuum cleaner.

15. The system of claim 1 wherein the vacuum cleaner further comprises a first portion with an intake nozzle and a second portion separate from the first portion and wherein the retention element is configured for attachment to the second portion of the vacuum cleaner.

16. The system of claim 1 wherein the vacuum cleaner further comprises a first portion with an intake nozzle and wherein the retention element is configured for attachment to the first portion of the vacuum cleaner.

17. The system of claim 1 wherein the vacuum cleaner further comprises a first portion with an opening into a housing and wherein the retention element is configured for attachment near the first portion of the vacuum cleaner at a location at which a flow of air travels toward the opening during operation such that the fragrant substance released by the fragrant mass travels with the flow of air into the housing.

18. The system of claim 17 further comprising an intake nozzle and a filtration system, wherein the opening is coupled to the intake nozzle such that the flow of air and the fragrant substance travels into the intake nozzle and is emitted from the filtration system.

19. The system of claim 17 further comprising a motor cooling air system, wherein the opening comprises a vent to the motor air cooling system such that the flow of air and of the fragrant substance is emitted from the vacuum cleaner via the motor cooling air system.

20. The system of claim 1 wherein the fragrant mass comprises a ceramic material.

21. The system of claim 1 wherein the fragrant mass comprises a polymeric material.

22. The system of claim 1 wherein the fragrant mass comprises a porous material.

23. The system of claim 1 wherein the fragrant mass comprises a foam material.

24. The system of claim 1 wherein the fragrant substance comprises an oil.

25. The system of claim 1 wherein the fragrant substance comprises a synthetic compound.

26. The system of claim 1 wherein the fragrant substance comprises an organic compound.

27. The system of claim 1 wherein the fragrant substance is not released from the fragrant mass when the fragrant mass is near ambient temperature.

28. The system of claim 1 wherein the fragrant substance is released from the fragrant mass at a release rate, the release rate being a function of the temperature of the fragrant mass.

29. A fragrance delivery system having a vacuum cleaner, the vacuum cleaner having a housing and a motor within the housing, the housing having at least one sensitive area at which heat generated by the motor during operation of the vacuum cleaner raises the temperature of the at least one sensitive area above an ambient temperature, the system further comprising:

a mass impregnable with a fragrant substance, the mass being removably coupled to the at least one sensitive area on the vacuum cleaner housing, the fragrant substance being heat sensitive such that, when the motor is not operating, the fragrant substance is in a stable form, and when the motor is operated, the temperature of the mass increases and at least some of the fragrant substance is released from the fragrant mass.

30. A fragrance delivery system comprising:

a floor care device having a housing, a motor within the housing, and a motor cooling system with a vent, the housing having a sensitive area near the vent where heat generated by the motor during operation of the floor care device raises the temperature of the sensitive area above an ambient temperature; and a mass impregnable with a fragrant substance, the mass being removably coupled to the sensitive area of the housing in a path of air passing through the vent, the fragrant substance being heat sensitive such that, when the motor is not operating, the fragrant substance is in a stable form, and when the motor is operated, the temperature of the mass increases and at least some of the fragrant substance is released from the fragrant mass, drawn into the vent, and emitted by the motor cooling system.

31. The fragrance delivery system of claim 30 wherein the floor care device comprises a vacuum cleaner.

32. The fragrance delivery system of claim 30 wherein the floor care device comprises an upright vacuum cleaner.

33. The fragrance delivery system of claim 30 wherein the floor care device comprises a canister vacuum cleaner.

34. The fragrance delivery system of claim 30 wherein the floor care device comprises a hand-held vacuum cleaner.

35. The fragrance delivery system of claim 30 wherein the floor care device comprises a floor machine.

36. The fragrance delivery system of claim 30 wherein the floor care device comprises an extractor.

37. A fragrance delivery system comprising:

a floor care device having a motor, the floor care device having at least one sensitive area at which heat generated by the motor during operation of the floor care device raises the temperature of the at least one sensitive area above an ambient temperature; and a mass impregnable with a fragrant substance, the mass being removably coupled to the at least one sensitive area on the floor care device, the fragrant substance being heat sensitive such that, when the motor is not operating, the fragrant substance is in a stable form, and when the motor is operated, the temperature of the mass increases and at least some of the fragrant substance is released from the fragrant mass.

38. A method for distributing a fragrant substance during use of a floor care device, the method comprising:

providing a medium adapted to be impregnated with a liquid;

impregnating the medium with a heat sensitive, fragrant substance, the heat sensitive, fragrant substance being substantially stable at an ambient temperature;

providing a floor care device having a body and a motor within the body, the body having at least one sensitive area at which heat is generated by the motor during operation of the floor care device;

coupling the medium to the at least one sensitive area on the floor care device; and operating the floor care device to elevate the temperature of the at least one sensitive area and to activate the heat sensitive, fragrant substance thus causing distribution of the fragrant substance.

39. The method of claim 38 wherein the floor care device is a vacuum cleaner, and wherein operating the floor care device comprises vacuuming at least a portion of a floor.

40. The method of claim 38, further comprising a retention element coupled to the floor care device, and wherein coupling the medium to the sensitive area comprises engaging the medium with the retention element.

41. The method of claim 38 wherein impregnating the medium comprises applying the heat sensitive, fragrant substance in a liquid state to the medium.

42. The method of claim 38 wherein impregnating the medium is performed prior to coupling the medium to the floor care device.

* * * * *

UNITED STATES PATENT AND TRADEMARK OFFICE

CERTIFICATE OF CORRECTION

PATENT NO. : 6,511,548 B1 
DATED : January 28, 2003
INVENTOR(S) : David L. Oreck and Bruce M. Kiern It is certified that error appears in the above-identified patent and that said Letters Patent is hereby corrected as shown below:

Title page,
Item [75], Inventors, replace "David I. Oreck, New Orleans, LA (US); Bruce M. Kiern, Gulfport, MI (US)" with -- David I. Oreck, New Orleans, LA (US); Bruce M. Kiern, Gulfport, MS (US) --

Signed and Sealed this

Tenth Day of June, 2003

JAMES E. ROGAN
*Director of the United States Patent and Trademark Office*